US006402079B1

(12) United States Patent
Hermanns et al.

(10) Patent No.: US 6,402,079 B1
(45) Date of Patent: Jun. 11, 2002

(54) WINDING STATION OF AN AUTOMATIC BOBBIN WINDING MACHINE WITH A WET SPLICING DEVICE

(75) Inventors: Ferdinand-Josef Hermanns, Erkelenz; Gerard Küsters, Selfkant-Havert; Ottmar Neubig, Mönchengladbach, all of (DE)

(73) Assignee: W. Schlafhorst AG & Co. (DE)

( * ) Notice: Subject to any disclaimer, the term of this patent is extended or adjusted under 35 U.S.C. 154(b) by 0 days.

(21) Appl. No.: 09/639,251

(22) Filed: Aug. 14, 2000

(30) Foreign Application Priority Data

Aug. 14, 1999 (DE) ..... 199 38 628

(51) Int. Cl.[7] ..... B65H 54/22; B65H 69/06; D01H 13/26

(52) U.S. Cl. ..... 242/475.5; 242/475.4; 57/22; 57/350

(58) Field of Search ..... 242/475.4, 475.5, 242/475.1; 57/22, 350

(56) References Cited

U.S. PATENT DOCUMENTS 3,070,947 A * 1/1963 Toledo et al. ..... 57/22
3,106,762 A 10/1963 Riera
3,751,981 A * 8/1973 Jernigan et al. ..... 57/22 X
4,506,497 A * 3/1985 Feuerlohn ..... 57/22
4,573,313 A 3/1986 Bertrams
4,852,339 A 8/1989 Premi
4,887,649 A * 12/1989 van Mullekom ..... 242/475.4 X
4,936,084 A * 6/1990 Matsui et al. ..... 57/22
4,998,566 A * 3/1991 Akiyama ..... 57/22 X
5,054,317 A 10/1991 Laubscher
5,768,873 A * 6/1998 Stiller ..... 57/22
5,857,637 A 1/1999 Straaten et al.

FOREIGN PATENT DOCUMENTS

| | | |
|---|---|---|
| DE | 3337895 | 5/1985 |
| DE | 3840035 | 6/1989 |
| DE | 3932667 | 4/1991 |
| DE | 19650879 | 6/1998 |
| EP | 0401600 | 12/1990 |
| GB | 2142780 A | 1/1985 |

* cited by examiner

*Primary Examiner*—Michael R. Mansen
*Assistant Examiner*—Minh-Chau Pham
(74) *Attorney, Agent, or Firm*—Kennedy Covington Lobdell & Hickman, LLP

(57) ABSTRACT

The winding station of an automatic bobbin winding machine has a splicing device (7) for the connection of yarn ends following a yarn break. Wet splices are created by the introduction of a liquid. A capacitive sensor (13) is arranged downstream of the splicing device (7), by means of which a dielectric change is detected when the moistened yarn passes. The capacitive sensor (13) is connected with an evaluation unit (12), which generates a signal when the change falls below a predeterminable threshold value $D_{SW}$ (32) because of an insufficient water content. The signal trigger a cleaning cut. The signals are used for monitoring of the yarn quality and monitoring the ability of the splicing device (7) to function. The invention permits the creation of wet splices of very low moisture content, without causing malfunctions in the winding process or reducing the yarn quality.

16 Claims, 4 Drawing Sheets

WINDING STATION OF AN AUTOMATIC BOBBIN WINDING MACHINE WITH A WET SPLICING DEVICE

CROSS REFERENCE TO RELATED APPLICATIONS

This application claims the benefit of German Application DE P 19938628.5 filed Aug. 14, 1999, herein incorporated by reference.

FIELD OF THE INVENTION

The present invention relates to a yarn winding device having a yarn splicing device associated therewith, such as a winding station (sometimes referred to as a winding head) of an automatic bobbin winding machine which is commonly equipped with a splicing device for connecting yarn ends, e.g., after a yarn break. More particularly, the present invention relates to such a winding device having a splicing device wherein a liquid, in particular water, is introduced into the spliced connection.

BACKGROUND OF THE INVENTION

Splicing devices of the afore-described type typically operate by means of compressed air to connect two or possibly more yarn ends with each other by first opening, i.e., separating and loosening, the individual spun fibers of the yarn ends and then applying one or several spurts of compressed air to the loosened spun fibers of both yarn ends. A relatively strong connection resistant to tensile forces is created by the mutual entanglement, hooking together, swirling and winding of the fibers of the yarn ends. With particularly thin strands, or with strands of a particular fiber structure, the cohesion of the respective fibers to each other may possibly not be sufficient to achieve a splice of a desirable strength. In such cases wherein yarns consisting of particular spun fibers, for example flax fibers, do not have acceptable cohesive characteristics for splicing, a metered amount of a liquid is added to the yarn ends and a so-called wet splice is created to improve the connecting process, the stability and/or the appearance of the spliced location. Besides the yarn from flax fibers, wet splices are also employed with yarn of other natural vegetable fibers, such as cotton thread or denim yarns.

Such a yarn splicing device is known, for example, from German Patent Publication DE 33 37 895 C2, wherein an injection device adds water to the splicing air during splicing. In this device, the amount of water must be exactly metered, atomized and conducted to the splicing chamber together with the similarly metered splicing air.

A preferred case for the employment of splicing devices is, for example, in the winding stations of bobbin winding machines, such as are disclosed in German Patent Publication DE 196 50 879 A1.

In a further embodiment of a wet splicing device, such as represented in German Patent Publication DE 33 23 982 C2, a moistening line terminates in the compressed air line leading to the splicing chamber. By this arrangement, the amount of moisture is meteringly introduced as a function of the length of the compressed air spurt.

The introduction of novel yarn technologies, in particular in the field of compact spinning, considerably increases the requirements made on wet splicing devices in comparison with the requirements made on the connecting techniques of yarns for producing linen.

The degree of general soiling of the winding station by the moisture given off during wet splicing in the course of the winding process plays an increasingly larger role. It is therefore desired to be able to keep the amount of splicing water low. The amount of water can be applied in a metered fashion by means of devices and methods such as described in already mentioned German Patent Publication DE 33 37 895 C2.

However, with every reduction of the amount of splicing water employed, the assurance that the splicing device receives sufficient water for the required stability of the wet splice, and therefore the stability of the yarn, is also reduced. For example, if an amount of water is selected for metering which clearly lies above the customary amount of water required for a sufficient stability of the yarn, then although an obstruction in the introduction of the water, for example by dirt in the feed line, will cause the amount of splicing water to fall below a set value, sufficient moisture will still always be introduced into the spliced connection to achieve the required stability of the yarn. On the other hand, if the predetermined setting of the amount of splicing water to be introduced into the spliced connection were to be reduced so greatly that the moisture in the spliced connection would be just sufficient for generating the required stability, the actually applied amount of water would no longer be sufficient if there were even a slight obstacle in the water supply, which would result in a noticeable lowering of the moisture content of the spliced connection. In turn, the stability of the spliced connection, and therefore the durability of the yarn, would become unsatisfactory in such case and would lead to yarn breaks, potential interruption of or other interference with the course of further yarn processes or uses, or also to reductions in the quality of the finished yarn. To avoid these disadvantages, the size of the amount of moisture to be applied in accordance with the known methods is kept relatively small, but for safety reasons is still made large enough so that it considerably exceeds the amount of moisture required for sufficient stability of the wet splice. Because of the mentioned concerns about the dependability of a wet splicing operation, the available tolerance for lowering the amount of moisture to be applied has not been exhausted or optimized in the known wet splicing devices.

OBJECT AND SUMMARY OF THE INVENTION

It is accordingly an object of the present invention to provide an improved wet splicing device which addresses the above mentioned disadvantages of known wet splicing devices and will eliminate or at least reduce such disadvantages. In particular, it is an object of the present invention to provide a wet splicing device which will assure a sufficient, moisture-dependent stability of spliced yarn connections while also reducing the amount of moisture to be applied in comparison to that of conventional wet splicing devices.

In accordance with the present invention, this objective is attained in an embodiment of a wet splicing device in a winding station of an automatic bobbin winding machine wherein a capacitive sensor is employed for purposes of evaluating the character and sufficiency of wet yarn splices formed with the device.

In a winding device employing a wet splicing device in association with a downstream yarn cleaner, the use of a capacitive sensor, such as is known, for example, from U.S. Pat. No. 3,106,762, is contraindicated, because even the smallest amounts of moisture from wet splice connections which may be deposited in the area of the capacitive sensor will lead to significant distortions of the yarn cleaning result. The same contraindication applies correspondingly to the employment of combined capacitive/optical sensors, such as are known, for example, from European Patent Publication EP 0 401 600 A2. If a drop of water clings to a sensor, distorted measurements result, and the respective sensor or measuring head can be wrongly adjusted. Subsequently, when the drop dries, a yarn number alarm can occur. This interferes with the production and the monitoring of the yarn quality. Although the amount of moisture may be kept relatively low in a wet splice, the capacitive measured values of the yarn change considerably because of this amount of moisture introduced, and would disadvantageously affect or distort the continuing monitoring of yarn quality. As a result, only optical sensors are customarily employed at winding stations with wet splicing devices. But the employment of only optical sensors considerably limits the measuring abilities and options, and therefore the number of measurable yarn parameters, as well as the dependability of the measured results, are more limited than could be achieved by the simultaneous evaluation of capacitive and optical measured values.

The present invention departs from the conventional wisdom and overcomes the prejudice that capacitive sensors should be avoided in connection with moistened spliced connections, as well as the conventional wisdom and prejudice that the desire for the smallest amount of water unavoidably leads to losses in the assurance of the yarn quality.

In accordance with the present invention, a capacitive sensor is arranged in the winding station downstream of the wet splicing device, by means of which a change in the dielectric value of the moistened spliced connection can be detected. The sensor is connected with an evaluation unit, which generates a signal when a predeterminable threshold value is not reached. Preferably, the generated signal is used as the error signal. An error report can be advantageously generated on a display means. In a preferred embodiment, a yarn cleaner is arranged in the yarn path, and the generated signal triggers a cleaning cut of the yarn. It is possible by means of such an embodiment of the winding station to remove an unsatisfactory spliced connection and to replace it by a proper spliced connection.

Spliced connections which are not moistened, or insufficiently moistened, are assuredly detected in this manner. The amount of splicing liquid which must be supplied and the resulting danger of soiling of components of the winding station may therefore be lowered. The effects on or distortion of measured values, and the continuing monitoring of the yarn quality, because of soiled sensors can be avoided.

Preferably, a memory for storing the generated signals is provided, whereby the generated signals may be used for monitoring the ability of the splicing device to function. In turn, in addition to remedying a lack in quality caused by spliced connections which are not sufficiently moistened, it is possible to also detect and repair a defect in the function of the splicing device. Criteria for the proper functioning of the splicing device and/or the inability of the splicing device to function correctly are preferably predetermined and stored. The generated signals are compared with such criteria and an error signal is generated if deviations from the criteria occur.

Means for cleaning components of the splicing device are advantageously provided. Thus, if an error signal occurs, cleaning of the components, as well as a subsequent repetition of the spliced connection, may be activated. The creation of further defective spliced connections may be prevented by turning off the winding station when an error signal has been issued.

In a preferred embodiment, the dielectric value is only specifically detected in the area of the spliced connection when the spliced connection passes the sensor, and a continuous mass determination of the yarn is not performed. Erroneous evaluations, in particular regarding the mass of the yarn, are avoided in this manner. An optical sensor is preferably also provided in addition to the capacitive sensor. The capacitive sensor advantageously also performs measurements of the yarn outside of the area of the spliced connection.

The determination of the density of the yarn, and therefore of a further yarn parameter, can be performed because of the employment of an optical sensor in addition to the capacitive sensor. With a combination of an optical sensor and a capacitive sensor, one sensor alone can perform the continuous checking of the yarn if the other sensor is temporarily used for other purposes.

As a result, the options for the use of the measuring arrangement, the number of measurable yarn parameters, as well as the dependability of the measurements are considerably increased. Means for determining statistical data regarding the total bobbin quality, as well as a monitoring system for displaying the results, are advantageously used for the further assurance of the yarn quality.

Soiling of the sensors or of the winding station in general by the moisture emitted by the spliced connection can be prevented if the amount of liquid introduced into the spliced connection lies below 0.15 ml, and in particular below 0.1 ml. The threshold value is less than the desired amount. The difference between the desired amount and the threshold value must at least correspond to the amount of water required for a sufficient stability of the spliced connection.

In a simple manner the present invention makes it possible to utilize the advantages resulting from a reduction of the amount of moisture introduced into the spliced connection, and to avoid the disadvantages of too large an amount of moisture in the spliced connection, without endangering the assurance of achieving a sufficient durability of the yarn and a desired yarn quality.

Further details, features and advantages of the present invention will be described and will be understood from the disclosure of a preferred embodiment of the present invention hereinbelow with reference to the accompanying drawing figures.

DETAILED DESCRIPTION OF THE PREFERRED EMBODIMENTS

Figure 1:
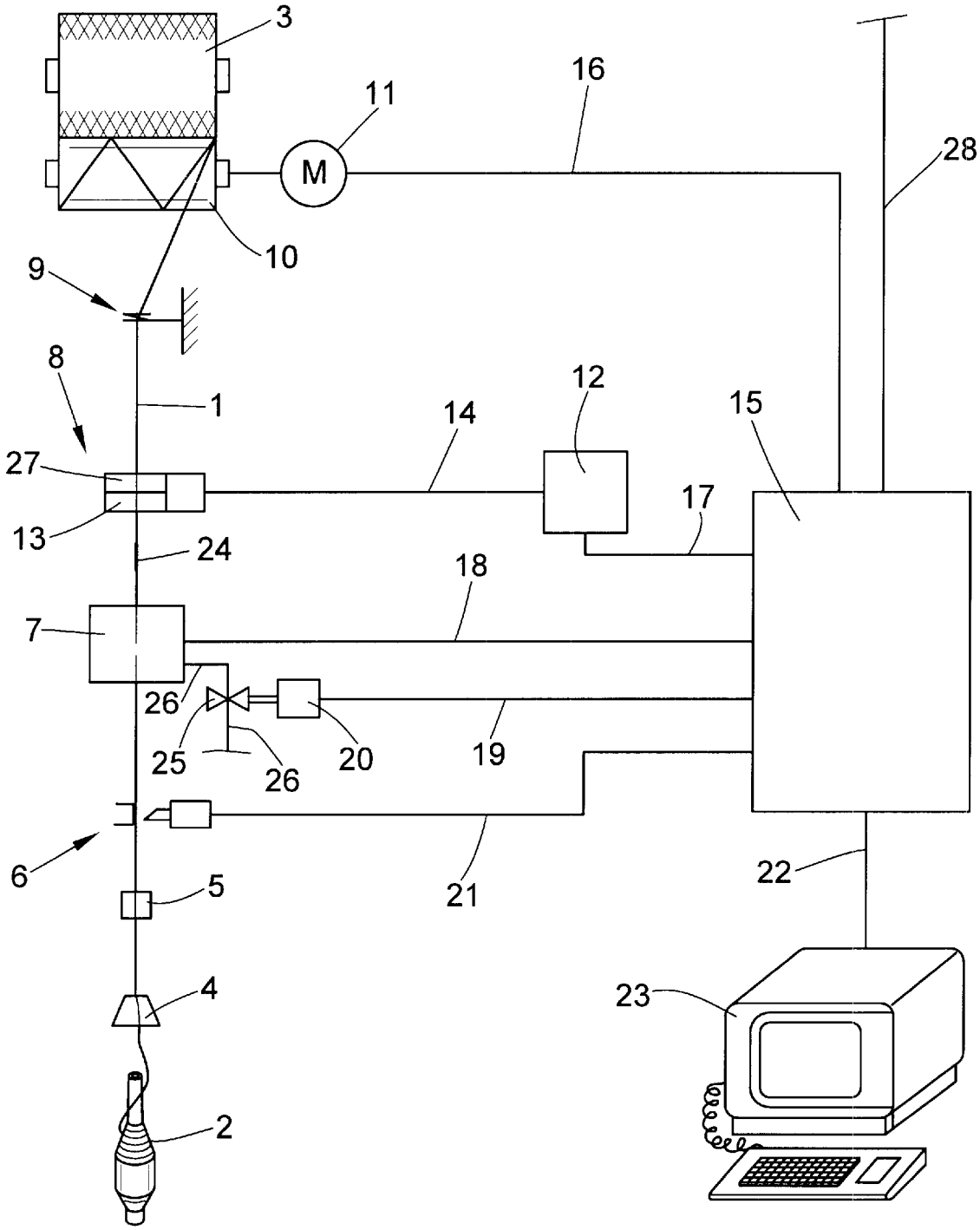
FIG. 1 is a schematic representation of a preferred embodiment of a wet yarn splicing device in a winding station of an automatic winding machine in accordance with the present invention.

Referring now to the accompanying drawings and initially to FIG. 1, a yarn winding station such as in a known type of automatic winding machine is represented wherein a yarn 1 is withdrawn from a spinning cop 2 and wound onto a cheese 3. In the process, the traveling yarn 1 first passes by a balloon limiter 4 and a yarn tensing device 5. Thereafter, the yarn 1 passes through a yarn cutting device 6, a splicing device 7, a cleaner 8 and a guide eye 9. A drive drum 10 drives the cheese 3 by frictional surface contact during the winding process. A motor 11 imparts rotating movement to the drive drum 10. The cleaner 8 has a capacitive sensor 13, and is connected via a line 14 with an evaluation unit 12. A memory has been integrated into the evaluation unit 12 in the exemplary embodiment represented in FIG. 1. A control device 15 is connected via a line 16 with the motor 11, via a line 17 with the evaluation unit 12, and therefore via the evaluation unit 12 with the cleaner 8, via a line 18 with the splicing device 7, via a line 19 with an actuating device 20, and via a line 21 with the yarn cutting device 6. The control device is connected via a line 22 with a data processing device 23, which has means for detecting statistical data regarding the total bobbin quality, as well as a monitoring system for displaying the results. A line 28 is used for data exchange with further devices for controlling, data storage, or evaluation, and for controlling further elements of respectively the winding station or the bobbin winding machine.

Further details, for example of the drive mechanism or the control, which have not been represented for reasons of simplicity and greater clarity, ensue from the prior art disclosed in German Patent Publication DE 196 50 879 A1 or others of the above cited references.

A spliced connection 24 created by the splicing device 7 is charged with an exactly metered small amount of liquid, and subsequently passes through the capacitive sensor 13 of the cleaner 8. In spite of the small amount of liquid, the measured capacitive value created by moisture in the spliced connection 24 still is considerably greater than the measured capacitive value created by the mass of the yarn 1. The moment of the passage of the spliced connection 24 through the sensor 13 is predetermined by means of a length measurement, known per se, of the yarn 1 wound on the cheese 3, and a target-oriented measurement of the dielectric value of the spliced connection is performed in a predetermined section 29 of the yarn 1, which includes the spliced connection 24. In the course of this measurement, the yarn mass outside of the spliced connection 24 is first measured, then the total mass of the spliced connection 24 itself is measured, and then the yarn mass following the spliced connection 24 is measured. Here, the moisture in the spliced connection 24 results in a defined rise and subsequent drop of the measured value.

Figure 2:
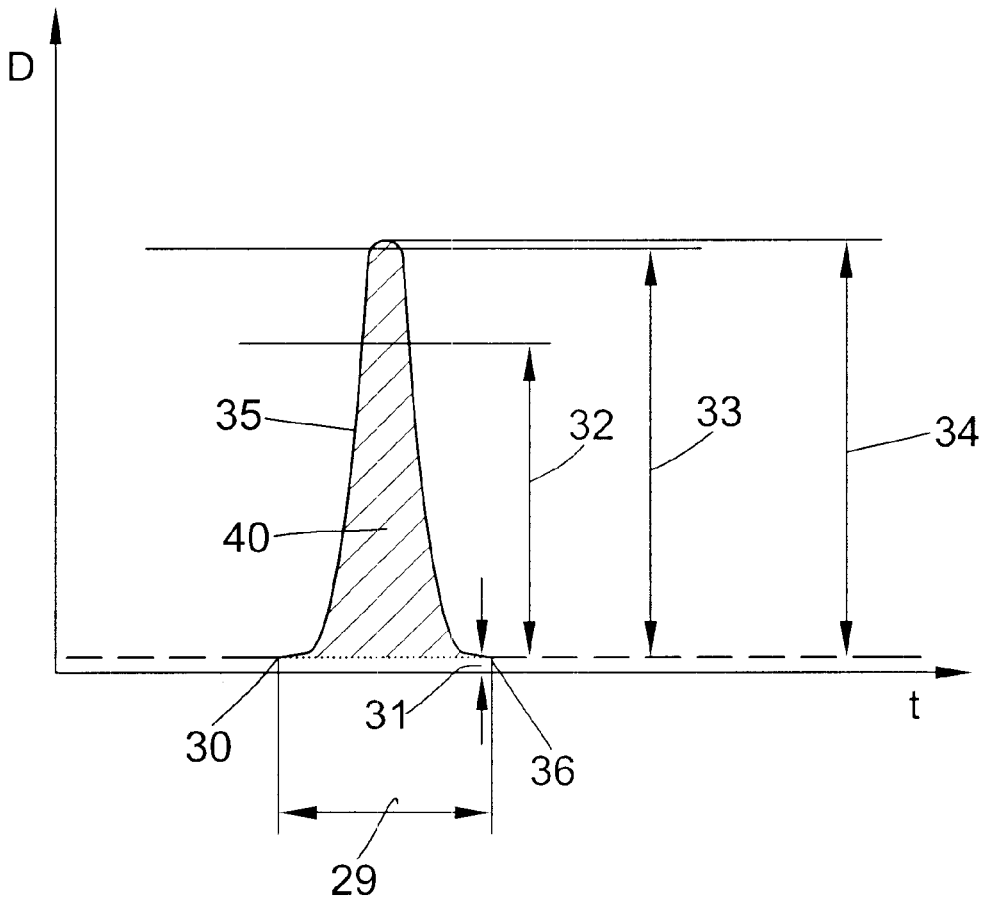
FIG. 2 is a schematic representation of a result of a measurement performed by the wet yarn splicing device in accordance with the present invention by means of which the amount of water in the wet splice is indicated.

FIG. 2 shows the measured values plotted as a curve over a time axis. At the start of the section 29 of the yarn 1, at the point indicated by the reference numeral 30, the curve extends on a low level, generated by the yarn mass outside of the spliced connection 24, showing the measured value $D_M$ 31. The curve 35 exceeds the threshold value $D_{SW}$ 32 and reaches its maximum at the measured value $D_{max}$ 34, wherein the amount of moisture represented by the measured value $D_{max}$ 34 lies slightly above the desired value $D_{Soll}$ 33 for the amount of moisture to be introduced. For example, the measured value $D_{max}$ 34 can be forty times the value of $D_M$ 31. At the end of the section 29, at the point identified by the reference numeral 36, the curve 35 has dropped back to the measured value $D_M$ 32. Here, the requirement applicable to a sufficient amount of moisture $$D_{SW}<D_{max}$$

has been met. No error signal is generated.

Alternatively or in addition, an evaluation can also be performed wherein the area 40, enclosed by the curve 35 and the value $D_M$ 31 and shown in hatched lines in FIG. 2, is used as the basis for determining the amount of the change caused as a result of the moisture content of the spliced connection 24 and is compared with an appropriate threshold value. In this case also, a signal is triggered when the appropriate threshold value is not reached.

Figure 3:
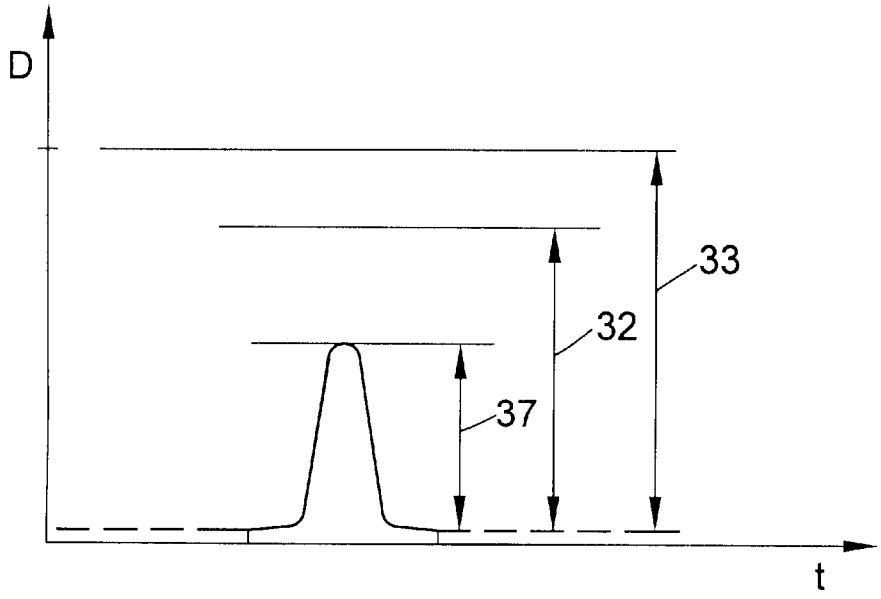
FIG. 3 is a schematic representation of a result of a measurement performed by the wet yarn splicing device in accordance with the present invention by means of which an insufficient amount of water in the wet splice is indicated.

FIG. 3 shows a change caused by the amount of moisture in the spliced connection 24, whose value $D_T$ 37 does not reach the desired value $D_{Soll}$ 33, and also lies below the predetermined threshold value $D_{SW}$ 32. As a result, $$D_{SW}>D_T,$$

and the requirement applying to a sufficient amount of moisture $$D_{SW}<D_{max}$$

has not been met. Accordingly, a signal is generated because the threshold value $D_{SW}$ 32had not been reached. The generated signal is used as an error signal and can be shown by means of a display, for example by means of the monitor of the data processing device 23, as an error indication.

On the basis of the generated signal, the yarn cutting device 6 is simultaneously or alternatively driven via the control device 15, and a cleaning cut is triggered. Thereafter, a spliced connection 24 is again made between the yarn ends and such spliced connection 24 also passes through the sensor 13 and is checked. If two or more successive repetitions of the splicing process occur, a lack of the ability of the splicing device 7 to function is assumed when a predetermined number of repetitions has been reached.

A fall below the threshold value of the detected change caused by the amount of moisture in the spliced connection can be one of the criteria for identifying a lack of the ability of the splicing device to function. Another criteria can be the exceeding of a further threshold value which indicates in such case that the amount of water is too great and that there is an increased danger of soiling because of wetting of the components of the winding station, in particular of measuring heads, and the subsequent bonding of dust to the moisture clinging to the surfaces.

Figure 4:
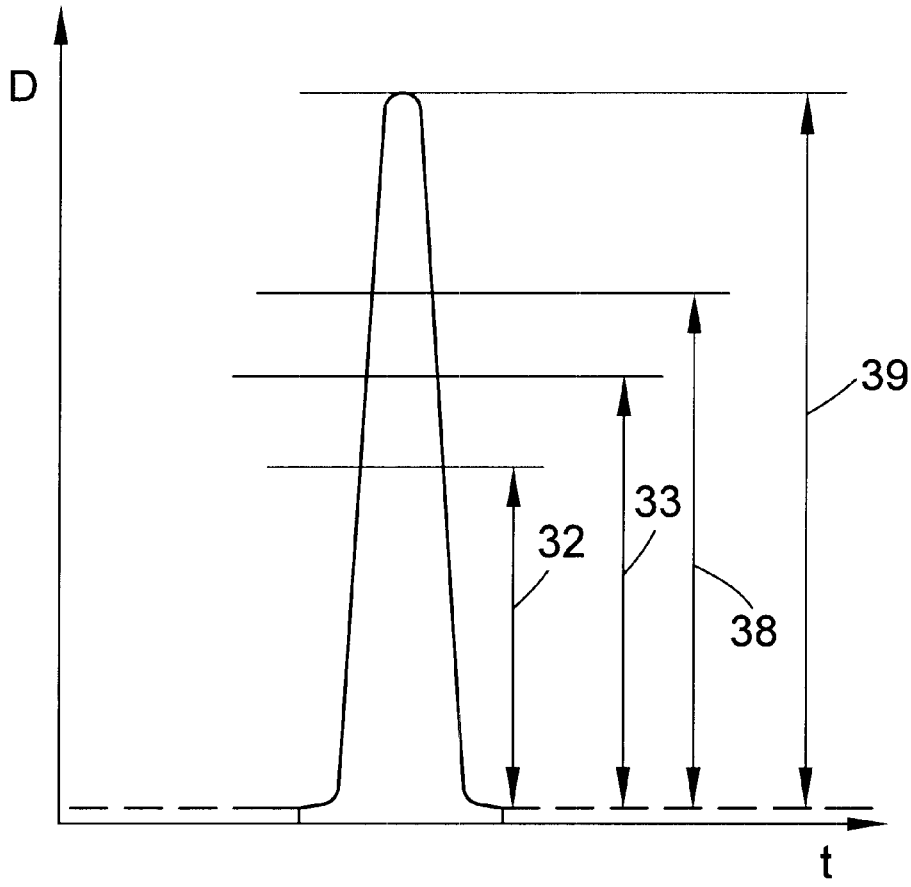
FIG. 4 is a further schematic representation of a result of a measurement performed by the wet yarn splicing device in accordance with the present invention by means of which too great an amount of water in the wet splice is indicated.

The exceeding of a further predetermined measured value $D_{SWO}$ 38 by the measured value $D_g$ 39 of the change caused by the amount of moisture in the spliced connection is represented in FIG. 4. The measured value $D_g$ 39 of the change exceeds the threshold value $D_{SW}$ 32, as well as the desired value $D_{Soll}$ 33, without a signal thereby being triggered. Exceeding the threshold value $D_{SWO}$ 38 by the measured value $D_g$ 39 generates a signal, which is used as an error signal. Therefore, $$D_g>D_{SWO}$$

and the condition $$D_g<D_{SWO},$$

which, along with the condition $D_{SW}<D_T$ mentioned above, additionally applies for limiting a permissible amount of moisture in the spliced connection 24, has not been met. In this case also, the yarn cutting device 6 is simultaneously driven because of the generated signal, and a yarn cleaning cut is triggered.

Inadequate spliced connections 24 can be caused by various errors or interferences. If a spliced connection 24 has been detected to indicate an error or problem in the splicing operation, the error could have been caused, for example, by a compressed air line in the splicing device 7 being plugged up. The actuating device 20 is triggered via the control device 15 and the line 19, and the metering valve 25 is set in such a way that the air from a compressed air source, not represented, is supplied to the splicing device 7 through the compressed air line 26 under a pressure which is increased in respect to the operating pressure so as to perform a blow-through with the goal of loosening and removing possible dirt therefrom. It is alternatively or additionally possible to perform cleaning of the water supply line by means of increased pressure. If a subsequent repetition of the splicing process again generates an unsatisfactory spliced connection 24, an error which cannot be automatically rectified, is assumed, the winding station is stopped and an error signal is generated and displayed.

A malfunction can furthermore also be caused by the water reservoir of the splicing device 7 being depleted, e.g., because filling of the water reservoir was hindered or interrupted.

Besides the capacitive sensor 13, the cleaner 8 has an optical sensor 27. In this manner, the measurement options of the present invention are considerably increased, and the dependability of the measured results and of the evaluations performed can be increased by an adjustment of the measured values. If the cleaner 8 performs measurements of the yarn 1 also outside of the area of the spliced connections 24, it is thereby possible to determine data regarding the entire bobbin travel, to evaluate them statistically and to display the results by means of a monitor system. The value for the detected mass of the yarn 1 outside of the area of the spliced connections 24, which corresponds to the measured value $D_M$ 31, is indicated by dashed lines in FIGS. 2 to 4 as the average value.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A winding station of an automatic bobbin winding machine, comprising a splicing device for connecting yarn ends after a yarn break, means associated with the splicing device for introducing a liquid into a spliced connection of yarn ends, a capacitive sensor arranged downstream of the splicing device for detecting a dielectric change representing the liquid in the spliced connection, and an evaluation device connected with the capacitive sensor and adapted to generate a signal when a detected dielectric change fails to satisfy a preselectable value.

2. The winding station in accordance with claim 1, characterized in that the signal generated by the evaluation device comprises an error signal, and characterized further by a display device associated with the evaluation device for displaying an error message.

3. The winding station in accordance with claim 1, characterized further by a cleaner arranged in a travel path of the yarn, and wherein the signal generated by the evaluation device comprises a signal for actuating the cleaner to perform a cleaning yarn cut.

4. The winding station in accordance with claim 1, characterized further by a memory for storing the signal generated by the evaluation device, and means for monitoring the functioning of the splicing device based on the signal generated by the evaluation device.

5. The winding station in accordance with claim 4, characterized in that means for monitoring the functioning of the splicing device includes stored predetermined criteria representing a lack of the splicing device to function correctly, means for comparing the signal generated by the evaluation device with the stored predetermined criteria, and means for generating an error signal based on the comparison.

6. The winding station in accordance with claim 1, characterized further by means for cleaning components of the splicing device, means for actuating the cleaning means in response to the signal generated by the evaluation device, and means for actuating a repeated actuation of the splicing device.

7. The winding station in accordance with claim 1, characterized further by means for shutting down the winding station for maintenance in response to the signal generated by the evaluation device.

8. The winding station in accordance with claim 1, characterized in the capacitive sensor is operative to detect the yarn essentially only in the area of the spliced connection.

9. The winding station in accordance with claim 1, characterized in that the capacitive sensor is operative to detect the yarn outside of the area of the spliced connection.

10. The winding station in accordance with claim 1, characterized further by an optical sensor for detecting another value of the yarn.

11. The winding station in accordance with claim 1, characterized further by means for collecting statistical data obtained from at least one of the capacitive sensor and the evaluation device, and a monitoring system for displaying the statistical data.

12. The winding station in accordance with claim 1, characterized in that the preselectable value is an amount of moisture to be introduced into the spliced connection.

13. The winding station in accordance with claim 12, characterized in that the preselectable value of an amount of moisture to be introduced into the spliced connection is less than about 0.15 ml.

14. The winding station in accordance with claim 12, characterized in that the preselectable value of an amount of moisture to be introduced into the spliced connection is less than about 0.1 ml.

15. The winding station in accordance with claim 1, characterized in that the preselectable value is a change in the amount of liquid in the yarn in the area of the spliced connection.

16. The winding station in accordance with claim 15, characterized in that the preselectable value of a change in the amount of liquid in the yarn in the area of the spliced connection is at least about 0.02 ml below a predetermined amount of liquid to be introduced into the spliced connection.

* * * * *